United States Patent [19]

Hong

[11] Patent Number: 4,779,555

[45] Date of Patent: Oct. 25, 1988

[54] INFLATABLE BOAT ASSEMBLY

[76] Inventor: Kwang S. Hong, Jukong Apt. 208-406, Kaepo-Dong, Kangnam-Gu, Seoul, Rep. of Korea

[21] Appl. No.: 49,220

[22] Filed: May 13, 1987

Related U.S. Application Data

[63] Continuation-in-part of Ser. No. 874,173, May 16, 1986, abandoned.

[30] Foreign Application Priority Data

Sep. 17, 1984 [KR] Rep. of Korea ..... 84-9081

[51] Int. Cl.[4] ..... B63B 7/08

[52] U.S. Cl. ..... 114/345; 441/40

[58] Field of Search ..... 114/345; 441/39, 40, 441/41

[56] References Cited

U.S. PATENT DOCUMENTS

| | | | |
|---|---|---|---|
| 117,817 | 8/1871 | Robeson | 114/345 |
| 3,261,038 | 7/1966 | Klepper | 114/345 |
| 3,812,805 | 5/1974 | Forssell et al. | 114/345 |

FOREIGN PATENT DOCUMENTS

| | | | |
|---|---|---|---|
| 3507353 | 9/1986 | Fed. Rep. of Germany | 114/345 |
| 2495096 | 6/1982 | France | 441/40 |
| 2564415 | 11/1985 | France | 114/345 |
| 1277480 | 6/1972 | United Kingdom | 114/345 |

*Primary Examiner*—Sherman D. Basinger
*Assistant Examiner*—Thomas J. Brahan
*Attorney, Agent, or Firm*—Birch, Stewart, Kolasch & Birch

[57] ABSTRACT

An inflatable boat assembly comprises a hull including a recess disposed at the front outside portion thereof and longitudinal grooves disposed at the outer side walls thereof, and an inflatable U-shaped floating tube containing longitudinal projecting rails disposed at the inner side walls thereof for tightly engaging the tube to the hull whereby the boat assembly provides an improved floating force which produces improved safety against sinking.

9 Claims, 3 Drawing Sheets

INFLATABLE BOAT ASSEMBLY

CROSS-REFERENCE TO RELATED APPLICATION

This application is a continuation-in-part of Application Ser. No. 874,173 filed May 16, 1986, for "ASSEMBLING INFLATABLE BOAT", now abandoned.

BACKGROUND OF THE INVENTION

The present invention relates to an inflatable boat assembly and more particularly, to a rigid hull engaged with an inflatable U-shaped floating tube and installed with an outboard motor thereon. The boat assembly of the present invention provides an improved floating force which produces improved safety against sinking.

Inflatable boats made of rubber material are known which can be punctured by sharp objects causing the boats to become waterlogged. Furthermore, since the bottom of such boats is flexible, a separate rigid floor should be fitted thereon. There is the other problem with the prior art boats, that is, it is difficult for them to be assembled or disassembled.

In order to reduce or eliminate these problems, an inflatable boat has been suggested such as that discloses in U.S. Pat. No. 3,261,038 wherein a shell having two side walls is provided; a floatation tube is utilized for engaging each of concave outer faces of the walls of the shell, and straps are provided for securing the tube to the shell. However, it is difficult to assembly, disassemble or transport such a boat since the boat requires three basic components for assembly. Also the shell of the prior art patent is of a large construction which makes it difficult to transport and assemble.

Also, German Pat. No. 1,222,813 discloses an inflatable dinghy which has inflatable walls and a base of flexible, waterproof material stretched therebetween, However, this dinghy is a single unit and not a boat assembly, that is, it is not comprised of a plurality of elements which can be disassembled for storage and easy transportation.

OBJECTS AND SUMMARY OF THE INVENTION

Accordingly, it is an object of the present invention to provide an improved inflatable boat assembly.

Another object of the present invention is to provide a boat assembly comprising only two basic components, that is, a rigid hull having longitudinal grooves disposed at the outer side walls thereof and an inflatable U-shaped floating tube having longitudinal projecting rails disposed at the inner side walls thereof for tightly engaging with the longitudinal grooves of the hull.

Still another object of the present invention is to provide a boat assembly which is structured with a recess disposed at the front outside portion of the hull for providing a buffer space between the hull and the tube when the tube is attached to the hull. This buffer space acts to prevent the water flow from leaking between the tube and the hull and thus transferring water into the boat during high speed operation, and further adds to the buoyancy of the boat.

A further object of the present invention is to provide a boat assembly wherein the height of the side wall of the hull is shorter than the diameter of the tube for materially reducing the size of the boat while at the same time providing a soft cushioned area for the operator to sit without slipping.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to an inflatable boat assembly which comprises a hull including a recess disposed at the front outside portion thereof and longitudinal grooves disposed at the outer side walls thereof, and an inflatable U-shaped floating tube containing longitudinal projecting rails disposed at the inner side walls thereof for tightly engaging the tube to the hull whereby the boat assembly provides an improved floating force which produces improved safety against sinking.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
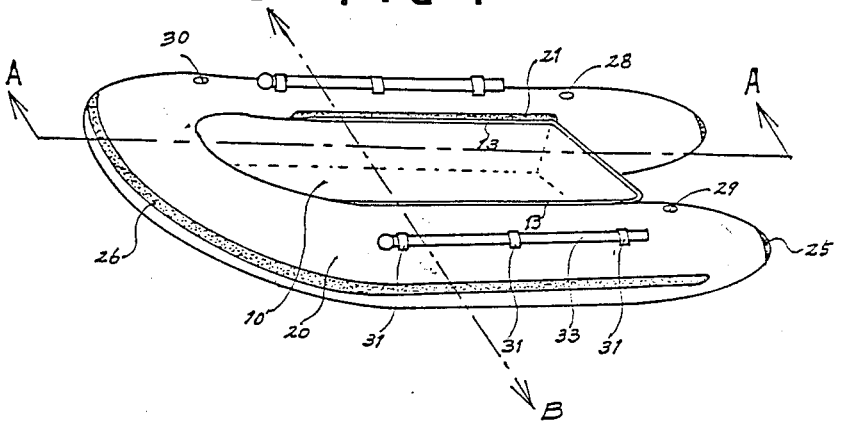
FIG. 1 is a perspective view of the inflatable boat assembly of the present invention.
Figure 2:
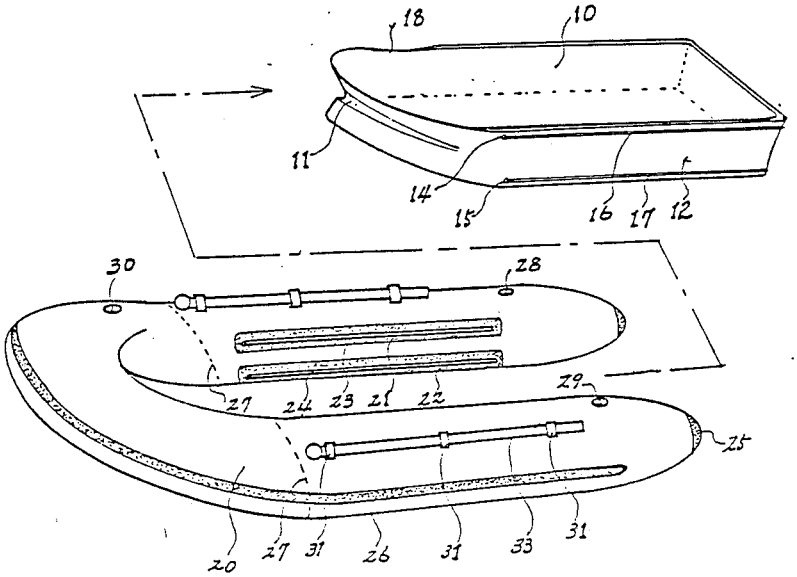
FIG. 2 is an exploded view of the inflatable boat assembly of the present invention.

Referring now in detail to the drawings for the purpose of illustrating the present invention, the inflatable boat assembly as shown in FIGS. 1 and 2 comprises a hull 10 including a recess 11 disposed at the front outside portion thereof and longitudinal grooves 14 and 15 disposed at the outer side walls 12 thereof. Longitudinal plates 21 and 22 containing longitudinal projecting rails 23 and 24 are attached to a U-shaped inflatable tube 20 for tightly engaging with the grooves 14 and 15 of the hull 10.

The hull 10 which is made of a reinforced synthetic resin forms a rigid boat so that the hull 10 is light in weight and possesses shock resistant properties. The rigid hull 10 contains an extended front edge portion 18 which protects the passenger from obstacles such as water spray which is created as the boat is propelled on the water.

The U-shaped inflatable tube 20 is made of a rubber material and is composed of three sections; that is, a front section and left and right side sections which are defined by partitions 27. Separate air inlets 28, 29 and 30 are disposed on the three sections, respectively. Handles 33 are attached to the top of the tube 20 through brackets 31. Also a protection strip 26 and end caps 25 are provided for protecting the tube 20 from damage.

Figure 3:
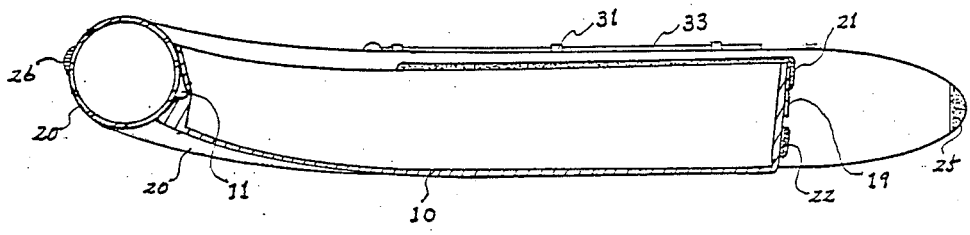
FIG. 3 is a cross-sectional, longitudinal view of FIG. 1, taken along line A—A.
Figure 5:
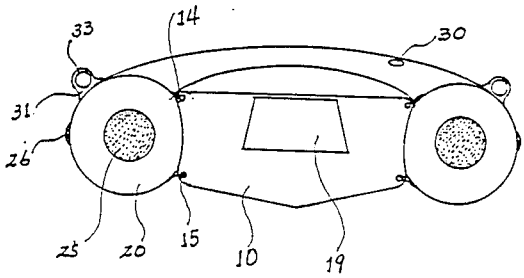
FIG. 5 is a rear elevational view of the inflatable boat assembly of the present invention.

As shown in FIGS. 3 and 5, a rigid pad 19 to which is installed an outboard motor (not shown), is adhered to the outer portion of the rear wall of the hull 10. The boat of the present invention may use the outboard motor secured to the pad 19 for moving the boat through the water.

Since the diameter of the projecting rails 23 and 24 disposed on the U-shaped tube 20 is larger than the spaces 16 and 17 of the grooves 14 and 15 disposed on the hull 10, the rails 23 and 24 can be tightly secured to the grooves when the rails of tube 20 are inserted into the grooves of the hull from the front to the rear of the hull 10.

Figure 4:
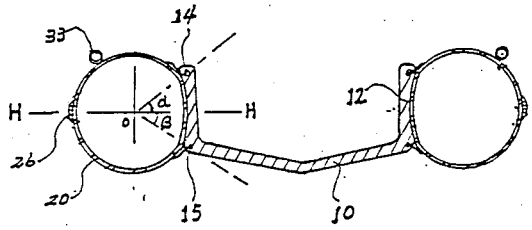
FIG. 4 is a cross-sectional, end view of FIG. 1, taken along line B—B.
Figure 7:
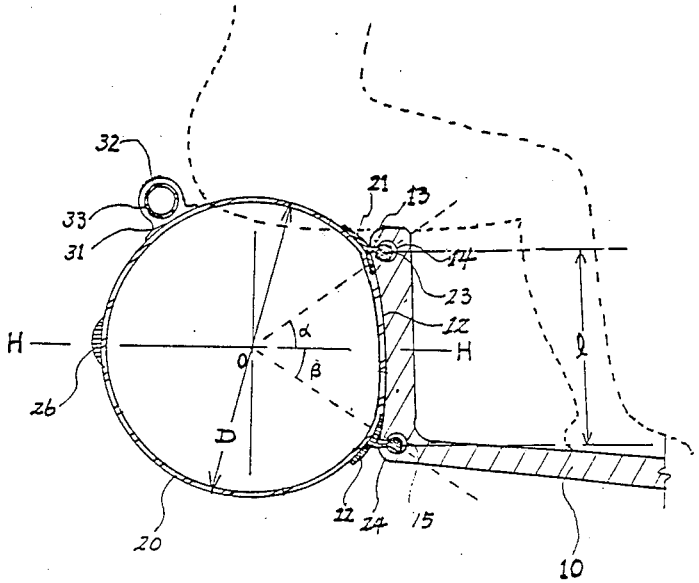
FIG. 7 is a sectional view showing the attachment of the U-shaped tube to the hull.

As shown in FIGS. 4 and 7, an arc $\alpha$ which extends from a horizontal plane H to the groove 14 and an arc $\beta$ which extends from the horizontal plane H to the groove 15 vary from 55° to 99°. That is $55° \leqq \alpha + \beta \leqq 99°$. The distance between the grooves 14 and 15 is about $0.4 \times$ to $0.8 \times D$ wherein D approximately represents the diameter of the tube 20. Therefore, even though the hull 10 is smaller than the conventional inflatable boat assembly the hull does not extend over the top surface of the inflatable tube 20 (FIG. 7). Because of this construction, the overall dimension of the hull is materially reduced in size and also the occupant is able to sit on a soft cushioned area of the inflated tube.

Figure 6:
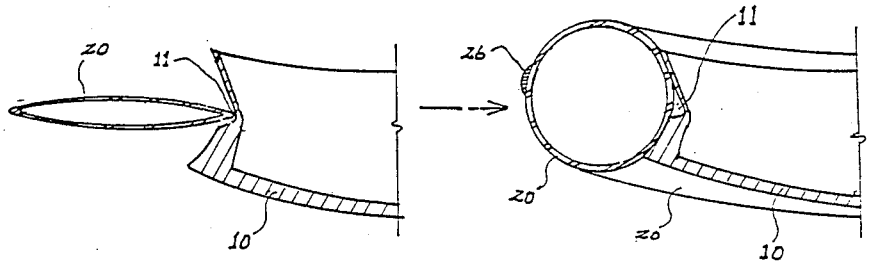
FIG. 6 is a sectional view showing how the recess disposed at the front outside portion of the hull forms a buffer space between the hull and the inflated tube.

As shown in FIGS. 3 and 6, first of all, the recess 11 is utilized to easily guide the deflated tube 20 to the hull 10. Secondly, when the tube 20 is inflated, the deflated tube 20 still engages with the recess 11 and a buffer space is created between the tube 20 and the recess 11 of the hull 10. Accordingly, the recess 11 functions to tightly engage the tube 20 to the hull 10 and to prevent the water from leaking into the hull.

In operation, first of all, the deflated U-shaped tube 20 is inserted to the hull 10 to engage the longitudinal projecting rails 23 and 24 with the longitudinal grooves 14 and 15 and to simultaneously engage the front portion of the tube 20 with the recess 11 of the rigid hull 10 as shown in FIGS. 2 and 6. Secondly, the air is inserted into the three portions of the tube through the air inlets 28, 29 and 30, respectively. At this time, the tube 20 is tightly engaged to the hull (FIGS. 1 and 6).

The inflatable boat assembly can be propelled by using an outboard motor (not seen) installed on the pad 19. Thus, the boat assembly of the present invention can produce an improved floating force by adding the buoyancy of the boat with the buffer space between the tube 20 and recess 11 of the hull 10.

If the inflated tube 20 is deflated, the hull 10 cannot sink since the tube 20 forms three separate compartments. Furthermore, since the hull 10 is a kind of boat, the boat assembly of the present invention produces improved safety against sinking.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

I claim:

1. A light weight inflatable boat assembly which comprises:

an inflatable U-shaped floating tube, a rigid hull having a concave prow and concave lateral side walls for receiving said floating tube, said side walls containing a pair of longitudinal grooves disposed at the outside surface of said lateral side walls, respectively, and a recess formed on the outside surface of said concave prow forward of said grooves, said concave walls of said rigid hull having a height slightly shorter than the diameter of said inflatable U-shaped tube for providing a soft cushioned sitting area which surrounds the rigid hull, said inflatable U-shaped floating tube containing a pair of longitudinal projecting rails disposed on the outside surface of the inner side thereof for tight engagement with said longitudinal grooves, whereby, when the inflatable tube is positioned with the rigid hull, the front portion of the inflatable tube engages with the recess in the prow to form a buffer space which prevents water from leaking into the boat and further adds to the buoyancy of the boat.

2. The inflatable boat assembly of claim 1 wherein points of attachment between said inflatable tube and said hull define an arc which varies from 55° to 99°, respectively.

3. The inflatable boat assembly of claim 1 wherein a distance between the pair of grooves is less than $0.8 \times D$, wherein D approximately represents the diameter of the tube.

4. The inflatable boat assembly of claim 1 wherein the U-shaped inflatable tube is composed of three separately sealed sections; that is, a front section and left and right side sections which are defined by partitions, said three sections containing separate inlets therefor.

5. The inflatable boat assembly of claim 1 wherein the longitudinal grooves are provided with openings disposed at front ends thereof, said front ends corresponding to rear ends of the longitudinal projecting rails, respectively.

6. The inflatable boat assembly of claim 1 wherein the diameter of the longitudinal projecting rails disposed on the U-shaped tube is larger than the space of the longitudinal grooves disposed on the hull for preventing the longitudinal projecting rails from separating from the longitudinal grooves.

7. The inflatable boat assembly of claim 1 wherein the inflatable U-shaped tube is provided with handles attached to the top of the tube.

8. The inflatable boat assembly of claim 1 wherein the inflatable U-shaped tube is provided with a protection strip and end caps for protecting the tube from damage.

9. The inflatable boat assembly of claim 1, further comprises a rigid pad to which is installed an outboard motor, said rigid pad being adhered to the outer portion of the rear wall of the hull.

* * * * *